US006290408B1

(12) United States Patent
Yorozu

(10) Patent No.: US 6,290,408 B1
(45) Date of Patent: Sep. 18, 2001

(54) RIBBON CASSETTE WITH FRICTION MECHANISM

(75) Inventor: Hideki Yorozu, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/431,904

(22) Filed: Nov. 2, 1999

(30) Foreign Application Priority Data

Nov. 10, 1998 (JP) ..... 10-319200

(51) Int. Cl.[7] ..... B41J 35/28

(52) U.S. Cl. ..... 400/208; 400/207; 400/208.1; 400/242; 400/247

(58) Field of Search ..... 400/207, 208, 400/208.1, 242, 247, 248, 248.1, 250

(56) References Cited

U.S. PATENT DOCUMENTS 4,732,500 * 3/1988 Biirgin ..... 400/208
5,135,319 * 8/1992 Kobayashi et al. ..... 400/208
5,304,008 * 4/1994 Asakura et al. ..... 400/234
5,429,443 * 7/1995 Kobayashi et al. ..... 400/229

FOREIGN PATENT DOCUMENTS 62 181175-A * 8/1987 (JP) .
2 212185-A * 8/1990 (JP) .
9 254507-A * 9/1997 (JP) .

* cited by examiner

*Primary Examiner*—John S. Hilten
*Assistant Examiner*—Minh H. Chau
(74) *Attorney, Agent, or Firm*—Brinks Hofer Gilson & Lione

(57) ABSTRACT

A friction mechanism exerts a frictional force on a feed pinch roller to apply a proper tensile load to an ink ribbon when the ink ribbon is fed.

6 Claims, 2 Drawing Sheets

RIBBON CASSETTE WITH FRICTION MECHANISM

BACKGROUND OF THE INVENTION

1. Field of the Invention

The present invention relates to a ribbon cassette for a thermal transfer printer and, more particularly, a ribbon cassette capable of stabilizing the movement of an ink ribbon.

2. Description of the Related Art

Generally, a thermal transfer printer presses a thermal print head mounted on a carriage through an ink ribbon and a recording medium, such as a paper sheet, against a platen, moves the carriage along the platen, drives the heating elements of the thermal print head selectively according to print data to transfer the ink of the ink ribbon to the recording medium in order that a desired image is printed on the recording medium. Since thermal transfer printers are capable of silently printing images in a high print quality, can be manufactured at low costs and are easy to maintain, thermal transfer printers are used prevalently as output devices for computers and word processors.

FIG. 4 is a plan view showing a main part of a conventional ribbon cassette used in such thermal printers.

Referring to FIG. 4, a take-up reel 4 for taking up an ink ribbon 3 and a feed reel 5 holding the coiled ink ribbon 3 are supported for rotation in a housing 1 having an upper case, not shown, and a lower case 2. A print head receiving part 6 is formed in a front portion of the housing 1 to be disposed opposite to the platen of the thermal transfer printer when the ribbon cassette is put in place on the carriage of the thermal transfer printer. When the ribbon cassette is put in place on the cartridge, a thermal head included in the thermal transfer printer is received in the print head receiving part 6. A take-up pinch roller 7 and a feed pinch roller 8 are supported for rotation at a position between the print head receiving part 6 and the take-up reel 4 and at a position between the print head receiving part 6 and the feed reel 5, respectively, on the housing 1. The take-up pinch roller 7 and the feed pinch roller 8 help the ink ribbon 3 move. Six guide rollers 9, 10, 11, 12, 13 and 14 are supported for rotation on pins projecting from the upper case and the lower case 2 to form a passage for the ink ribbon 3.

Each of the take-up reel 4 and the feed reel 5 is formed in a substantially cylindrical shape and has a bore provided with a plurality of splines. When the ribbon cassette is put in place on the carriage of the thermal transfer printer, a take-up shaft and a feed shaft are engaged with the take-up reel 4 and the feed reel 5, respectively. Each of the take-up pinch roller 7 and the feed pinch roller 8 is formed in a substantially cylindrical shape and has a bore provided with a plurality of splines, and when put in place on the carriage, they are engaged with a drive shaft and a tension shaft projecting from the carriage. The take-up pinch roller 7 and the feed pinch roller 8 have sleeves formed of an elastic, relatively highly frictional material. The guide rollers 13 and 14, and the guide rollers 9 and 10 are disposed so that the ink ribbon 3 wraps around the take-up pinch roller 7 and the feed pinch roller 8 at a contact angle in the range of 110° to 180°. The take-up pinch roller 7 is driven for rotation by the drive shaft of the thermal transfer printer to separate the used part of the ink ribbon 3 from the recording sheet. The feed pinch roller 8 is controlled by the tension shaft of the thermal transfer printer so as to apply a tensile load to the ink ribbon 3 to stabilize the movement of the ink ribbon 3.

The passage of the ink ribbon 3 extends from the feed reel 5 via the guide roller 9, the circumference of the feed pinch roller 8, the guide rollers 10, 11, 12 and 13, the circumference of the take-up pinch roller 7 and the guide roller 14 to the take-up reel 4. The ink ribbon 3 is exposed at the print head receiving part 6. The ink ribbon 3 unwound from the feed reel 5 travels along the passage and is taken up on the take-up reel 4.

The respective circumferences of the guide rollers 11 and 12 disposed at the opposite ends of the print head receiving part 6 lie on the outer side of a plane including the front side of the housing 1. The ink ribbon 3 is extended between the guide rollers 11 and 12 with its ink-coated surface in contact with the circumferences of the guide rollers 11 and 12 as indicated by broken line when the ink ribbon 3 is of a hot-peeling type. The ink ribbon 3 is extended between the guide rollers 11 and 12 with its back surface opposite its ink-coated surface in contact with the circumferences of the guide rollers 11 and 12 as indicated by solid line when the ink ribbon 3 is of a cold-peeling type.

The ink ribbon 3 enclosed in the housing 1 may be a hot-melt color ink ribbon having a layer of a hot-melt color ink, such as hot-melt yellow, cyan, magenta or black inks, a metallic ink ribbon having a layer of an ink having a metallic luster, a volatile color ink ribbon having a layer of a volatile color ink, an ink ribbon having a layer of a transparent hot-melt ink for undercoat printing or overcoat printing or a lustrous ink ribbon for printing a lustrous image by printing an image and heating the surface of the printed image for smoothing.

The type of the ink ribbon 3 is identified by detecting a type mark, not shown, formed on the housing 1 by an ink ribbon identifier mounted on the carriage of the thermal transfer printer.

Since the tensile load is applied to the ink ribbon 3 by the agency of the tension shaft of the thermal transfer printer, the tensile load is kept constant for all types of ink ribbons regardless of type. Therefore, all types of ink ribbons are not necessarily able to move steadily. Different types of ink ribbons behave differently when used for printing on the thermal transfer printer. Therefore, printing conditions, such as pressure for pressing the thermal print head against the platen, mode of driving the heating elements of the thermal print head and printing speed, are controlled to print images properly. However, it is impossible to stabilize the movement of all types of ink ribbons only through the control of the printing conditions for the thermal transfer printer and, consequently, images are printed in a poor print quality.

SUMMARY OF THE INVENTION

The present invention has been made in view of those problems and it is therefore an object of the present invention to provide a ribbon cassette comprising a housing capable of properly tensioning different types of ink ribbons and of stabilizing the movement of different types of ink ribbons by additionally incorporating therein some parts according to the type of an ink ribbon to be contained therein.

According to one aspect of the present invention, a ribbon cassette is provided with a friction mechanism in combination with a feed pinch roller to apply a tensile load to an ink ribbon. The friction mechanism exerts a frictional resistance against the rotation of the feed pinch roller to apply a proper tensile load on the ink ribbon.

Preferably, the friction mechanism comprises an elastic friction member capable of clasping an end part of a core barrel included in the feed pinch roller to exert a frictional resistance against the rotation of the feed pinch roller. The elastic clasping force of the elastic friction member is selectively determined to apply a proper tensile load to the ink ribbon.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
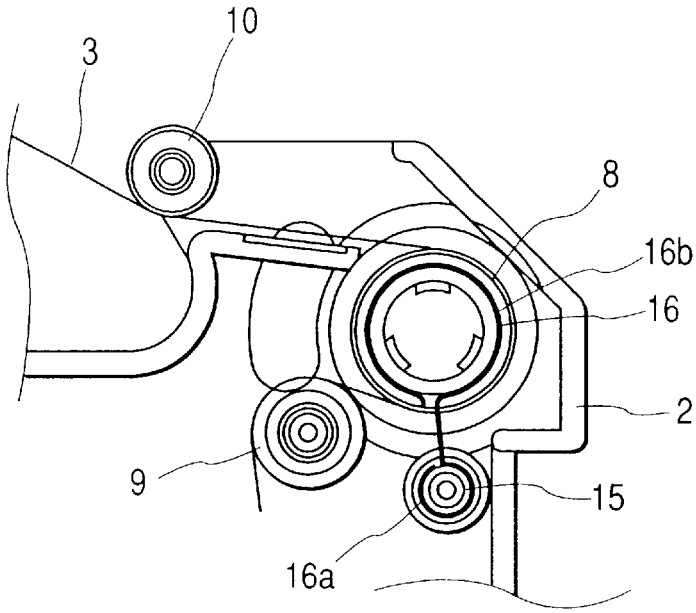
FIG. 1 is a fragmentary plan view of a ribbon cassette in a preferred embodiment according to the present invention.

A ribbon cassette in a preferred embodiment according to the present invention will be described with reference to FIGS. 1 to 3, in which parts similar or corresponding to those of the conventional ribbon cassette previously describe with reference to FIG. 4 will be designated by the same reference characters and the description thereof will be omitted.

Figure 2:
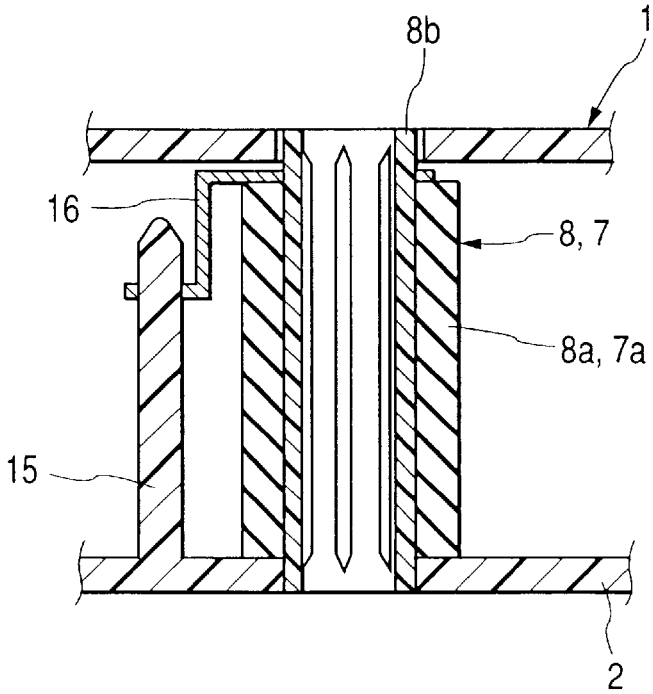
FIG. 2 is a sectional view of a portion of the ribbon cassette shown in FIG. 1 including a feed pinch roller and an elastic friction member.
Figure 3:
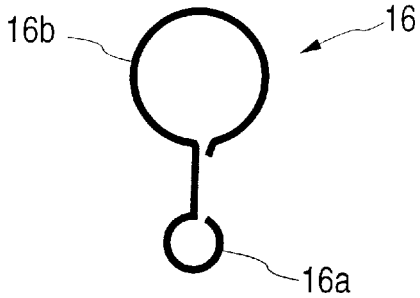
FIG. 3 is a plan view of the elastic friction member shown in FIG. 2.
Figure 4:
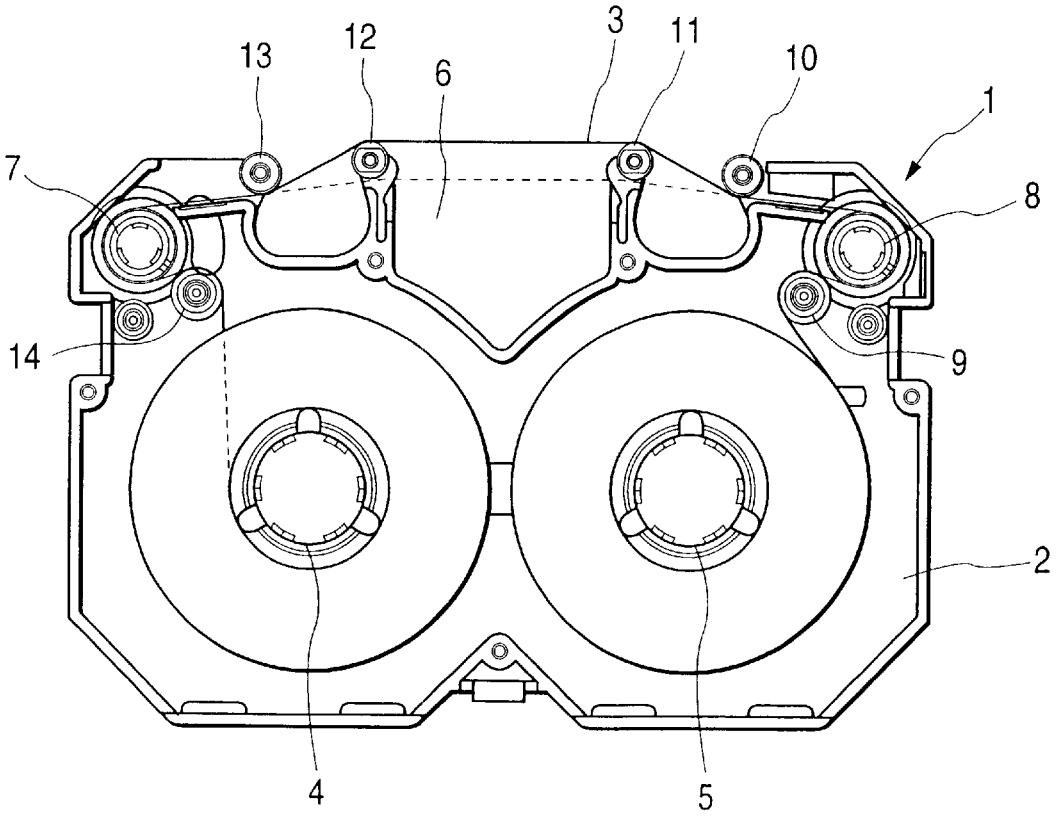
FIG. 4 PRIOR ART
FIG. 4 is a plan view of a conventional ribbon cassette.

Referring to FIGS. 1 to 3, a support pin 15 projects from a lower case 2 of a housing 1 at a position near a feed pinch roller 8 having a core barrel 8*b* and an elastic sleeve 8*a*put on the core barrel 8*b*. An elastic friction member 16 has a small round end 16*a* and a large round end 16*b*. The small round end 16*a* of the elastic friction member 16 is put on the support pin 15. The inside diameter of the small round end 16*a* is smaller than the diameter of the support pin 15. Therefore, the small round end 16*a* is elastically expanded to put the same on the support pin 15. The large round end 16*b* of the elastic friction member 16 is put on one end part of the core barrel 8*b* of the feed pinch roller 8. The inside diameter of the large round end 16*b* is smaller than the outside diameter of the core barrel 8*b* of the feed pinch roller 8. Therefore, the large round end 16*b* is expanded when putting the same on the end part of the core barrel 8*b* of the feed pinch roller 8. Consequently, the large round end 16*b* applies a frictional load on the feed pinch roller 8. The spring constant of the elastic friction member 16 and the inside diameter of the large round end 16*b* are selectively determined in order that a proper tensile load is applied to an ink ribbon 3 contained in and being pulled out of the housing 1.

Thus the movement of the ink ribbon 3 can be stabilized by combining the friction mechanism including the clasping spring 16 with the feed pinch roller 8. Some ribbon cassette having an ink ribbon 3 is inverted after the entire length of the ink ribbon 3 has been fed through its feed pinch roller 8 and has been taken up on its take-up reel to use the ink ribbon 3 again for printing by feeding the ink ribbon 3 through its take-up pinch roller 7. For such a ribbon cassette, the friction mechanism may be combined with the take-up pinch roller 7 to stabilize the movement of the ink ribbon 3 by applying a tensile load on the ink ribbon 3 being fed again for printing through the take-up pinch roller 7.

As apparent from the foregoing description, according to the present invention, a proper tensile load can be applied to the ink ribbon being fed through the feed pinch roller by the friction mechanism combined with the feed pinch roller and hence the movement of the ink ribbon can be stabilized. Consequently, images can printed in a stable print quality. The tensile load can properly be determined by selectively determining the spring constant of the elastic friction member and the inside diameter of the large round end of the elastic friction member according to the type of the ink ribbon contained in the housing. Accordingly, the stabilization of the movement of the ink ribbon which has been difficult to achieve only by the control function of the thermal transfer printer can be achieved regardless of the type of the ink ribbon.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A ribbon cassette comprising:

a take-up reel and a feed reel supported for rotation in a housing, and an ink ribbon wound on the take-up reel and the feed reel;

a print head receiving part formed in a section of a passage for the ink ribbon between the take-up reel and the feed reel to receive a thermal print head therein when the ribbon cassette is set in place on a thermal transfer printer;

a take-up pinch roller and a feed pinch roller supported for rotation at a position between the print head receiving part and the take-up reel and at a position between the print head receiving part and the feed reel, respectively; and a friction mechanism for exerting a frictional force to the feed pinch roller to apply a tensile load to the ink ribbon, wherein the friction mechanism comprises an elastic friction member capable of exerting a frictional force on a core barrel included in the feed pinch roller by clasping the core barrel.

2. A ribbon cassette according to claim 1, wherein the elastic friction member comprises a spring which clasps an exterior surface of the core barrel.

3. A ribbon cassette according to claim 2, wherein the spring comprises a first end and a second end, the first end being supported by a support pin attached to the housing, the second end comprising a circular member having an interior diameter that is smaller than an exterior diameter of the exterior surface of the core barrel.

4. A ribbon cassette according to claim 1, wherein the elastic friction member is replaceable with a second elastic friction member that is capable of exerting a different frictional force on the core barrel.

5. A ribbon cassette according to claim 1, further comprising a second friction mechanism for exerting a frictional force to the take-up pinch roller.

6. A ribbon cassette according to claim 5, wherein the second friction mechanism comprises a second elastic friction member capable of exerting a frictional force on a second core barrel included in the take-up pinch roller by clasping the second core barrel.

* * * * *